US007537438B2

(12) United States Patent
Song et al.

(10) Patent No.: US 7,537,438 B2
(45) Date of Patent: May 26, 2009

(54) RECIPROCATING COMPRESSOR

(75) Inventors: Gye-Young Song, Gyeonggi-Do (KR); Kwang-Wook Kim, Seoul (KR); Je-Nam Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 832 days.

(21) Appl. No.: 11/031,067

(22) Filed: Jan. 10, 2005

(65) Prior Publication Data

US 2006/0018771 A1 Jan. 26, 2006

(30) Foreign Application Priority Data

Jul. 26, 2004 (KR) ..... 10-2004-0058383

(51) Int. Cl.
*F04B 17/00* (2006.01)
*F04B 35/04* (2006.01)

(52) U.S. Cl. ..... 417/417; 417/363; 417/902; 310/12; 310/15; 92/130 R

(58) Field of Classification Search ..... 417/363, 417/417, 902; 310/12, 15; 92/130 R, 132, 92/135

See application file for complete search history.

(56) References Cited

U.S. PATENT DOCUMENTS 6,127,750 A * 10/2000 Dadd ..... 310/13
6,413,057 B1 7/2002 Hong et al.
7,284,967 B2 10/2007 Hyeon

FOREIGN PATENT DOCUMENTS

CN 1077253 A 10/1993
CN 1285471 A 2/2001
CN 1514909 A 7/2004
KR 10-0202581 B1 6/1999
KR 1999-0027472 U 7/1999
KR 2000-0013818 A 3/2000

* cited by examiner

*Primary Examiner*—Devon C Kramer
*Assistant Examiner*—Patrick Hamo
(74) *Attorney, Agent, or Firm*—Birch, Stewart, Kolasch & Birch, LLP

(57) ABSTRACT

A reciprocating compressor includes: a cylinder installed inside a casing and having a space therein; a piston disposed inside the cylinder; an inner stator fixed at an outer circumference of the cylinder; a magnet fixed at an outer circumference of the inner stator; and an outer stator disposed to maintain a certain distance from an outer circumference of the magnet. Accordingly, the number of components is reduced thus to reduce a manufacturing cost, and performance can be also improved.

18 Claims, 8 Drawing Sheets

RECIPROCATING COMPRESSOR

BACKGROUND OF THE INVENTION

1. Field of the Invention

The present invention relates to a reciprocating compressor, and particularly, to a reciprocating compressor in which a stator and a magnet are fixed to a cylinder and the cylinder is moved.

2. Description of the Background Art

In general, a reciprocating compressor is an apparatus for sucking, compressing and discharging a gas as a piston linearly reciprocates in a cylinder.

As shown in FIG. 1, a conventional reciprocating compressor includes: a casing 10 provided with a gas suction pipe 12 and a gas discharge pipe 14; a reciprocating motor 30 disposed inside the casing 10, for generating a driving force; a compression unit 40 for sucking, compressing and discharging a gas by the driving force of the reciprocating motor 30; a resonant spring unit 50 for providing a resonant motion to the reciprocating motion of the reciprocating motor 30; and a frame unit 20 for supporting the reciprocating motor 30, the compression unit 40 and the resonant spring unit 50.

As shown in FIG. 2, the reciprocating motor 30 includes: an outer stator 31 having a cylindrical shape as a plurality of lamination sheets 31*a* are radially laminated outside a winding coil 31*b*; an inner stator 32 disposed to maintain a certain air gap from an inner circumference of the outer stator 31, and having a cylindrical shape as a plurality of lamination sheets 32*a* are radially laminated; and a mover 33 disposed to maintain a certain distance (A) from an outer circumference of the inner stator 32 and linearly reciprocating.

The mover 33 includes: a magnet 33*b* disposed between the outer stator 31 and the inner stator 32; and a magnet frame 33*a* to which the magnet 33*b* is fixed.

The compression unit 40 includes: a cylinder 41 having an internal space; a piston 42 disposed inside the cylinder 41, connected to the mover 33 of the reciprocating motor 30 and linearly reciprocating to change a volume of a compression space (P) in the cylinder; a suction valve 43 mounted at a front side of the piston 42 (hereinafter, a side where a gas is sucked is referred to as a rear side, and a side where a gas is discharged is referred to as a front side.), and operated according to pressure of the compression space (P) thus to open or close a suction passage (F) of a gas; a discharge valve 44 installed at a front side of the cylinder 141, for opening or closing a discharge passage of a compressed gas; a valve spring 45 elastically supporting the discharge valve 44; and a discharge cover 46 receiving the discharge valve 44 and the valve spring 45, and connected to the gas discharge pipe 14.

The frame unit 20 includes: a first frame 21 mounted at front sides of the reciprocating motor 30 and the cylinder 41; a second frame 22 connected to the first frame 21, for supporting the outer stator 31 of the reciprocating motor 30 together with the first frame 21; and a third frame 23 connected to the second frame 22, for supporting the resonant spring unit 50 together with the second frame 22.

The resonant spring unit 50 includes: a spring sheet panel 51 disposed between the second frame 22 and the third frame 23 and connected to the mover 33 and the piston 42 thus to linearly reciprocate; a first spring 52 disposed between the second frame 22 and the spring sheet panel 51, compressed when the piston 42 moves frontward and extended when the piston 42 moves rearward; and a second spring 53 disposed between the third frame 23 and the spring sheet panel 51, extended when the piston 42 moves frontward and compressed when the piston 42 moves rearward.

As shown in FIG. 3, in the conventional compressor, when power is applied to the winding coil 31*b* of the outer stator 31, a flux is formed between the outer stator 31 and the inner stator 32, and the mover 33 linearly reciprocates in a direction of the flux. Accordingly, the piston 42 connected to the mover 33 changes a volume of the compression space (P). By such volume change of the compression space (P), a gas is sucked to, compressed in, and discharged from the compression space (P). At this time, the first and second springs 52 and 53 provide a resonant motion to the piston 42, thereby allowing the piston 42 to smoothly reciprocate. And, such a series of processes are repetitively performed.

However, the conventional reciprocating compressor having such a structure is disadvantageous in that its assembly processes are complicated because the mover 33 is disposed between the outer stator 31 and the inner stator 32 and the mover 33 is connected to the piston 42 and the spring sheet panel 51.

In addition, because the mover 33 should be provided with a magnet frame 33*a* for supporting the magnet 33*b*, the number of components is increased, which causes a cost increase.

Also, a certain distance (A) between the mover 33 and the inner stator 32 has to be maintained, but such a distance (A) causes loss of magnetic force between the outer stator 31 and the inner stator 32, thereby degrading efficiency of the reciprocating motor 30. And outer diameters of the mover 33 and the compressor become great because of the distance (A) between the mover 33 and the inner stator 32, thereby causing problems such as an increase in usage of magnets 33*b*.

SUMMARY OF THE INVENTION

Therefore, an object of the present invention is to provide a reciprocating compressor capable of reducing the number of components and improving workability when being manufactured, by fixing a stator and a magnet to a cylinder and moving the cylinder.

To achieve these and other advantages and in accordance with the purpose of the present invention, as embodied and broadly described herein, there is provided a reciprocating compressor capable of improving operational efficiency by reducing a size of an air gap between stators as a stator and a magnet are fixed to a cylinder and the cylinder is moved.

To achieve these and other advantages and in accordance with the purpose of the present invention, as embodied and broadly described herein, there is provided a reciprocating compressor comprising: a cylinder installed inside a casing and having a space therein; a piston disposed inside the cylinder; an inner stator fixed at an outer circumference of the cylinder; a magnet fixed at an outer circumference of the inner stator; and an outer stator disposed to maintain a certain distance from an outer circumference of the magnet.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
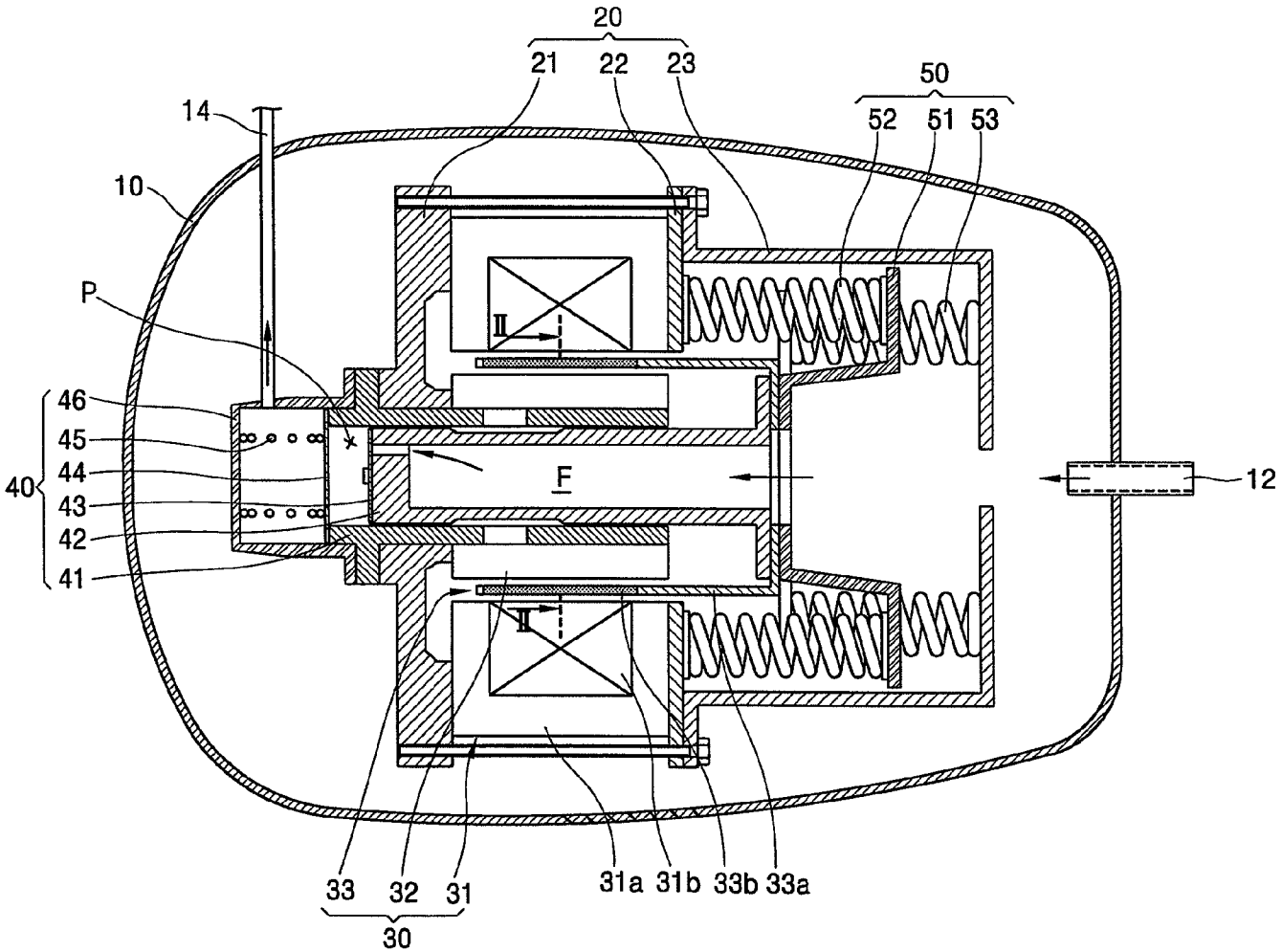
FIG. 1 CONVENTIONAL ART
FIG. 1 is a sectional view showing the conventional reciprocating compressor.
Figure 2:
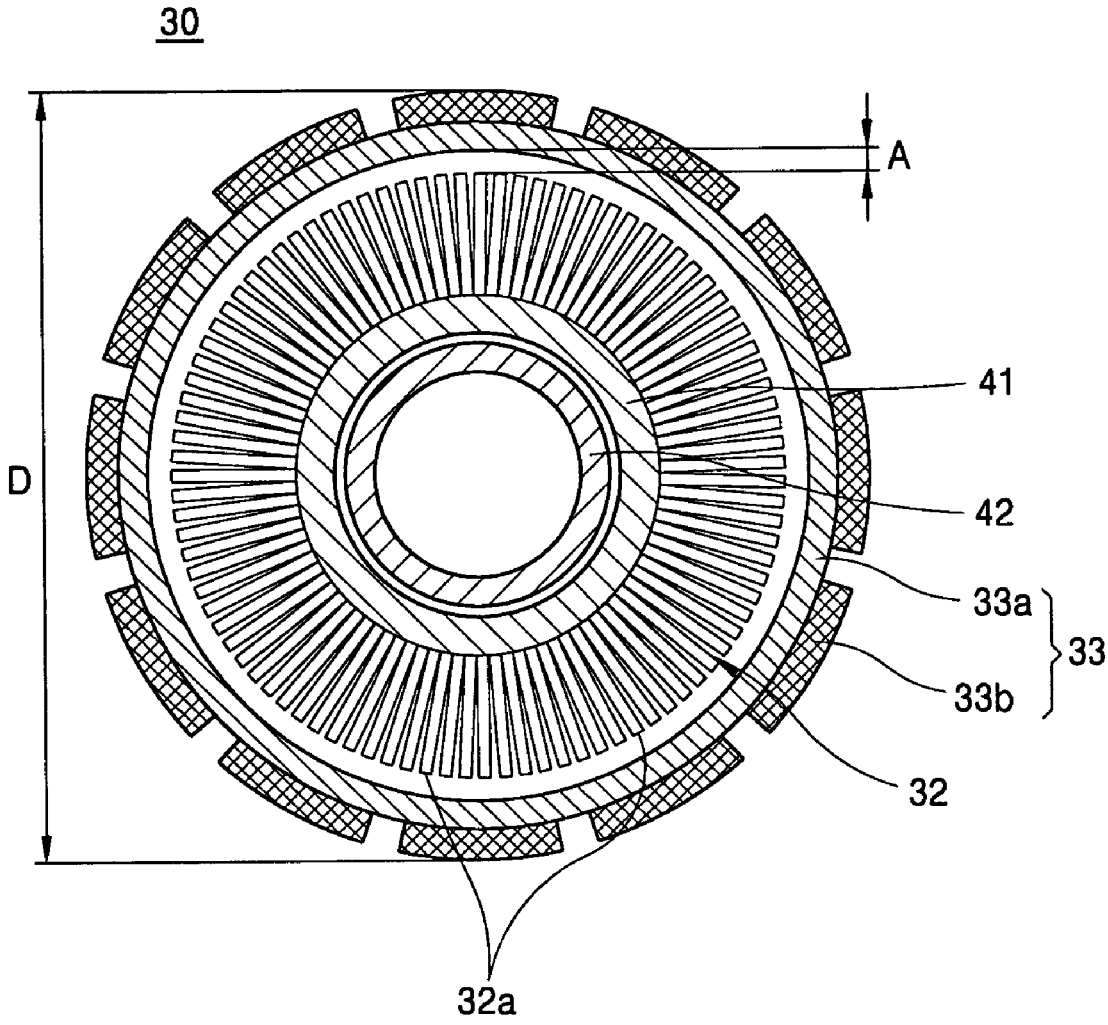
FIG. 2 CONVENTIONAL ART
FIG. 2 is a sectional view taken along line II-II of FIG. 1.
Figure 3:
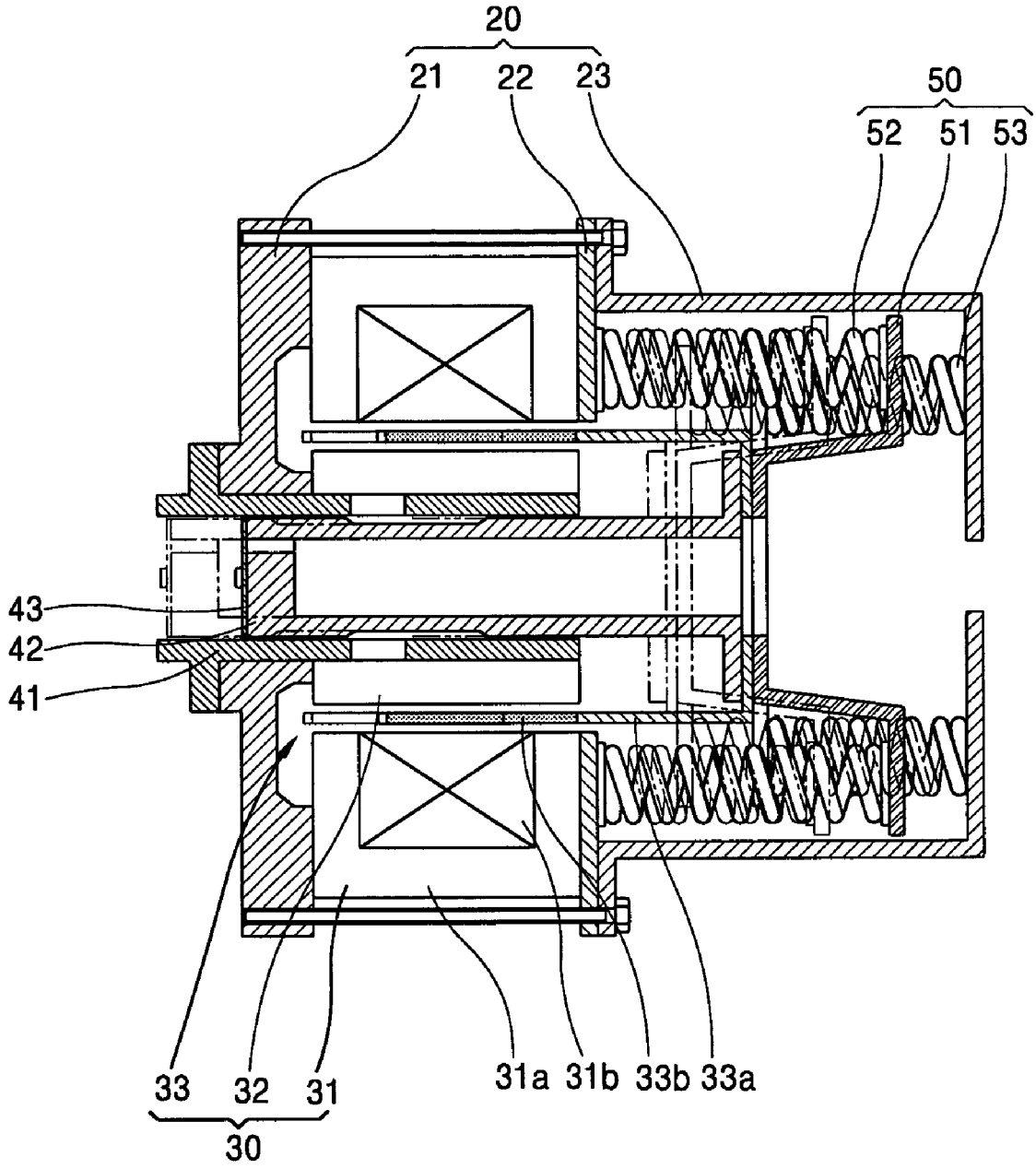
FIG. 3 CONVENTIONAL ART
FIG. 3 is a sectional view showing an operational state of the reciprocating compressor of FIG. 1.
Figure 4:
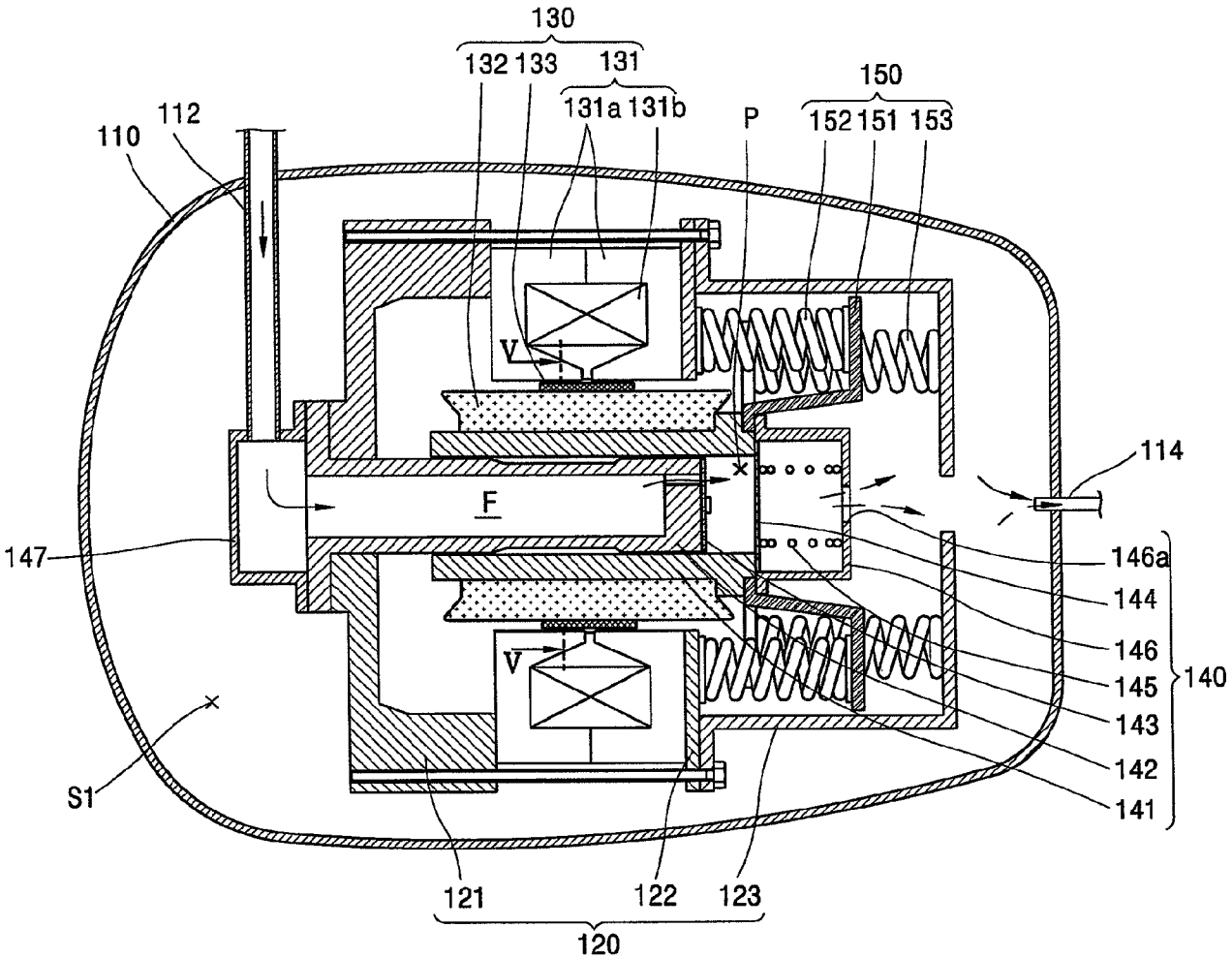
FIG. 4 is a sectional view showing a reciprocating compressor in accordance with an embodiment of the present invention.

As shown in FIG. 4, a reciprocating compressor in accordance with the present invention includes: a casing 110 provided with a gas suction pipe 112 and a gas discharge pipe 114; a reciprocating motor 130 disposed inside the casing 110, for generating a driving force; a compression unit 140 for sucking, compressing and discharging a gas by the driving force of the reciprocating motor 130; a resonant spring unit 150 for providing a resonant motion to a reciprocating motion generated at the reciprocating motor 130; and a frame unit 120 for supporting the reciprocating motor 130, the compression unit 140 and the resonant spring unit 150.

The gas suction pipe 112 directly communicates with the compression unit 140, and the gas discharge pipe 114 communicates with an internal space of the casing 110. Accordingly, the internal space of the casing 110 maintains an atmosphere of high pressure.

Figure 5:
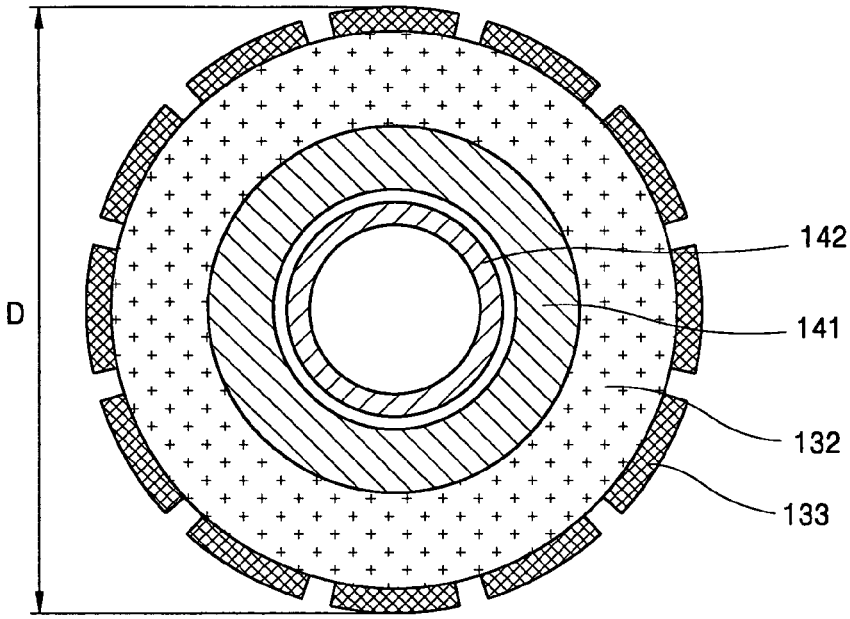
FIG. 5 is a sectional view taken along line V-V of FIG. 4.

As shown in FIG. 5, the reciprocating motor 130 includes: an outer stator 131 having a cylindrical shape as a plurality of lamination sheets 131*a* are radially laminated outside a winding coil 131*b*; a cylindrical inner stator 132 disposed to maintain a certain air gap from an inner circumference of the outer stator 131; and a magnet 133 installed at an outer circumference of the inner stator 132.

The outer stator 131 is formed through a process of laminating almost 'L' shaped lamination sheets 131*a* along a circumference of the winding coil 131*b* one by one, or a process of fixing a cylindrical core block, which is formed by integral lamination of a plurality of lamination sheets 131*a*, to the outside of the winding coil 131*b*.

The inner stator 132 is manufactured as a cylindrical shape in such a manner that a soft magnetic composition coated with an insulation-coating agent undergoes powder metallurgy, and is installed at an outer circumference of a cylinder 141 to be explained later.

Figure 6:
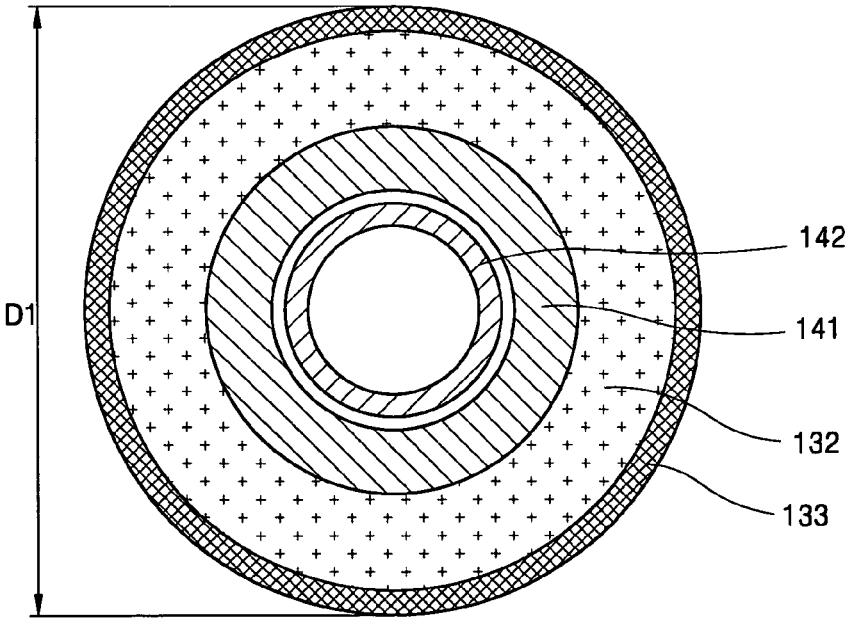
FIG. 6 is a sectional view showing a different example of a magnet provided in the reciprocating compressor of FIG. 4.

The magnet 133 is installed in plurality in a circumferential direction of an outer circumferential surface of the inner stator 132. But, not limited thereby, as shown in FIG. 6, the magnet 133 may be formed as a cylindrical shape and installed at an outer circumferential surface of the inner stator 132.

Figure 7:
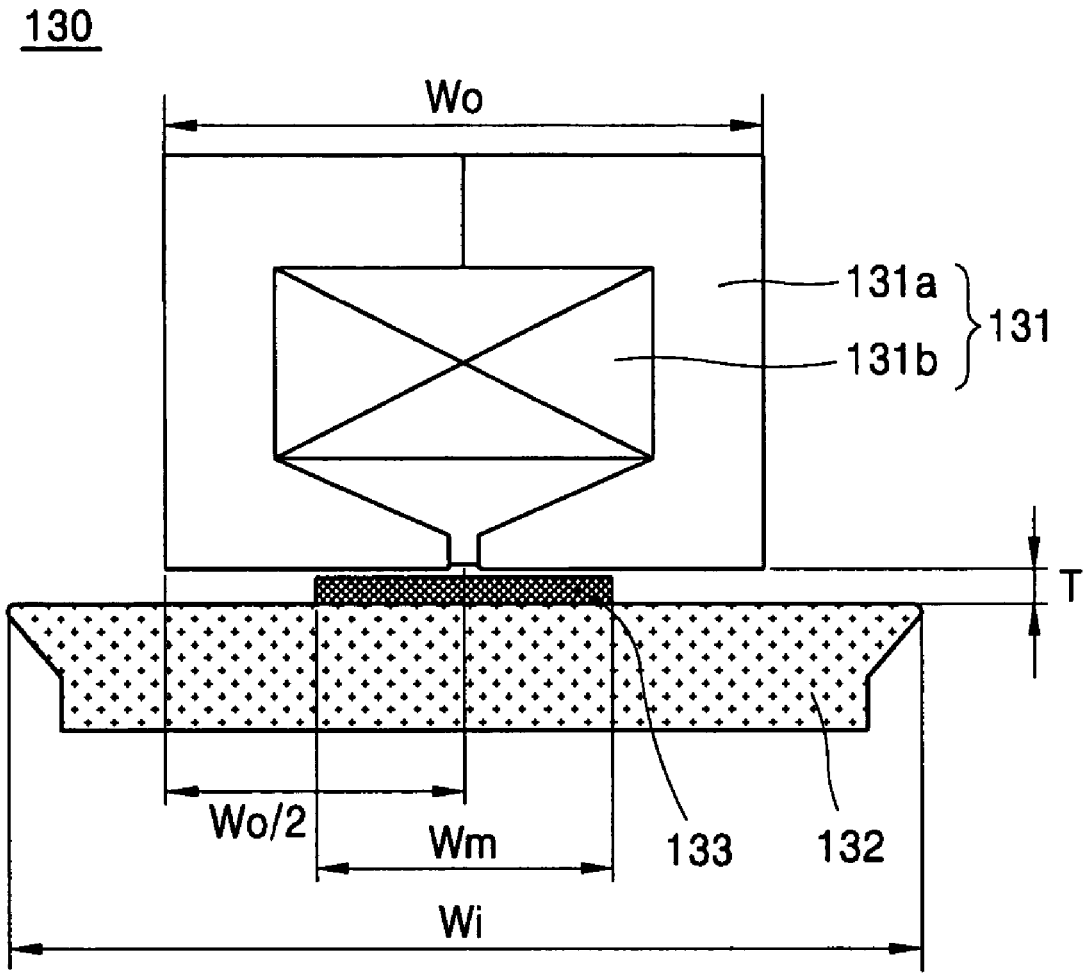
FIG. 7 is a sectional view showing a reciprocating motor provided in the reciprocating compressor of FIG. 4.

Meanwhile, as shown in FIG. 7, a width (Wi) in an axial direction of the inner stator 132, namely, in a direction of reciprocation is preferably wider than a width (Wo) in an axial direction of the outer stator 131.

In addition, a width (Wm) in an axial direction of the magnet 133 is wider than the half (Wo/2) of the width (Wo) in an axial direction of the outer stator 131, which is advantageous to formation of an effective line of magnetic force.

The compression unit 140 includes: a cylinder 141 having a compression space (P) therein and insertedly coupled to the inside of the inner stator 132 thus to linearly reciprocate; a piston 142 inserted in the cylinder 141 and fixed to the frame unit 120, wherein a suction passage (F) for suction of a gas is formed; a suction valve 143 mounted at a front side of the piston 142 (hereinafter, a side where a gas is sucked is referred to as a rear side, and a side where a gas is discharged is referred to as a front side.) and operated according to pressure in the compression space (P) thus to open or close the suction passage (F) of the gas; a suction cover 147 installed at a rear side of the piston 142 and communicating with the suction pipe 112, for covering the suction passage (F); a discharge valve 144 installed at a front side of the cylinder 141, for opening or closing a discharge passage of a compressed gas; a valve spring 145 for elastically supporting the discharge valve 144; and a discharge cover 146 receiving the discharge valve 144 and the valve spring 145 and having a discharge opening 146*a* through which the compressed gas is discharged into the casing 110.

Forming the cylinder 141 of a nonmagnetic body is an effective way to prevent magnetic force leakage.

The frame unit 120 includes: a first frame 121 to which the piston 142 is fixed; a second frame 122 connected to the first frame 121, for supporting the outer stator 131 of the reciprocating motor 130 together with the first frame 121; and a third frame 123 connected to the second frame 122, for supporting the resonant spring unit 150 together with the second frame 122.

The resonant spring unit 150 includes: a spring sheet panel 151 disposed between the second frame 122 and the third frame 123 and connected to the cylinder 141 thus to linearly reciprocate; a first spring 152 disposed between the second frame 122 and the spring sheet panel 151, extended when the cylinder 141 moves frontward and compressed when the cylinder moves rearward; and a second spring 153 disposed between the third frame 123 and the spring sheet panel 151, compressed when the cylinder 141 moves frontward and extended when the cylinder moves rearward.

Hereinafter, operation of the reciprocating compressor in accordance with the present invention having such a structure will now be described.

Figure 8:
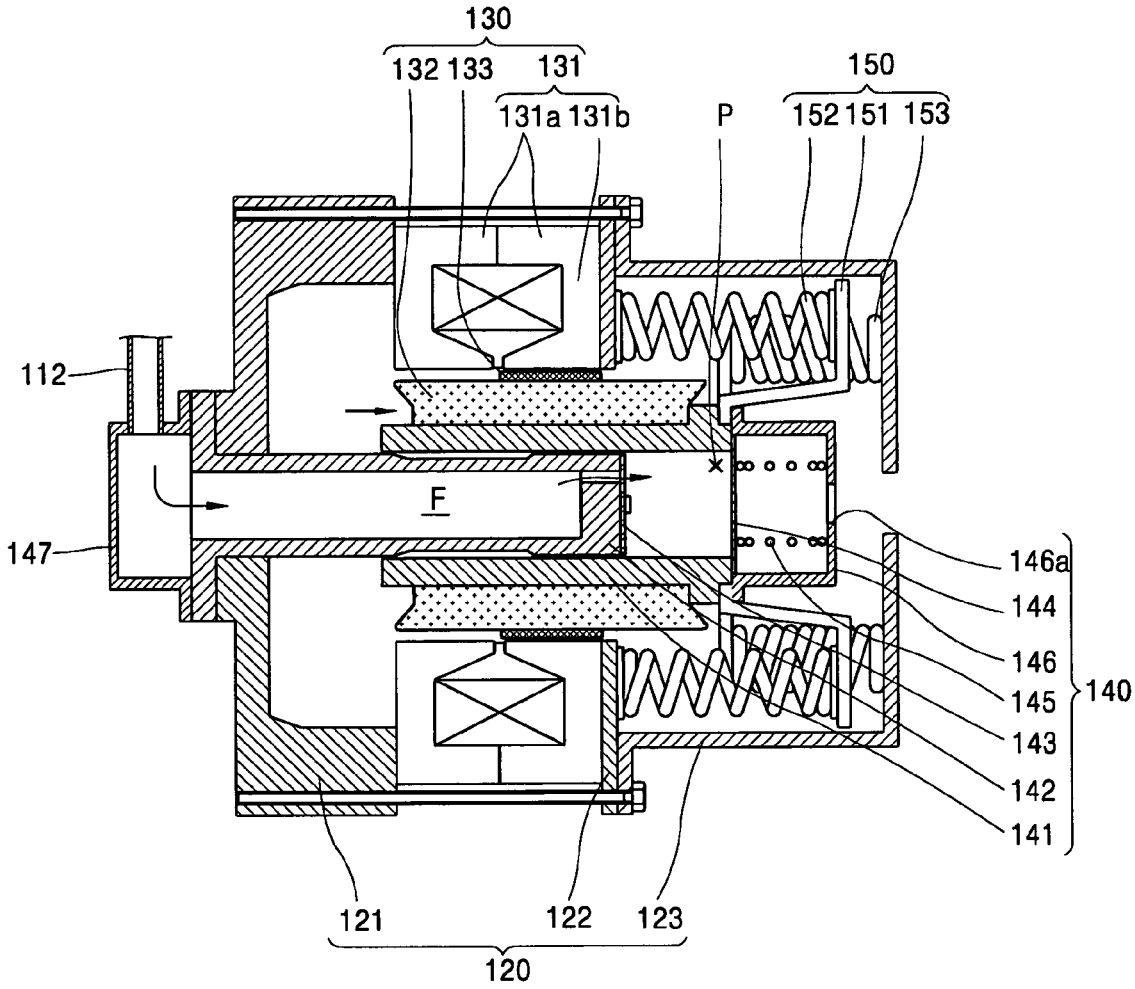
FIGS. 8 and 9 are sectional views showing an operational state of the reciprocating compressor of FIG. 4.
Figure 9:
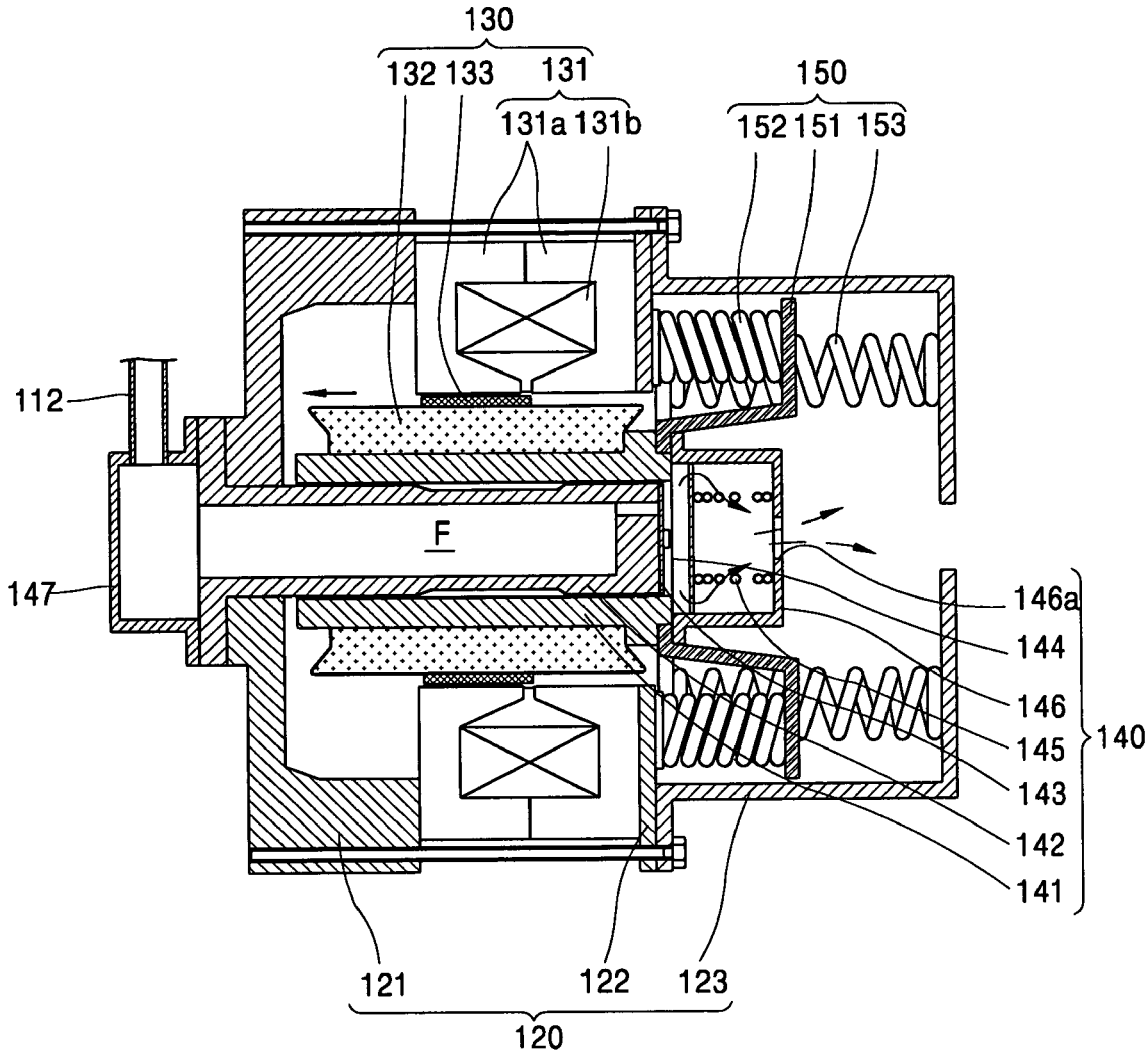

As shown in FIGS. 8 and 9, when power is applied to the winding coil 131*b* installed at the outer stator 131 of the reciprocating motor 130, a flux is formed between the outer stator 131 and the inner stator 132. Accordingly, the magnet 133 and the inner stator 132 linearly reciprocate in a direction of the flux. Accordingly, the cylinder 141 coupled to the inner stator 132 reciprocates, thereby changing a volume of the compression space (P) formed by the cylinder 141 and the piston 142.

Accordingly, by such a volume change of the compression space (P), a gas is sucked into, compressed in and discharged from the compression space (P). At this time, a resonant motion of the cylinder 141 is provided by the first and second springs 152 and 153, thereby allowing the cylinder 141 to smoothly reciprocate.

Here, as the gas suction pipe 112 penetrates the casing 110 and directly communicates with the suction cover 147, the gas is directly introduced to the suction passage (F) in the piston 142 without passing inside the casing 110. The gas compressed in the compression space (P) in the cylinder 141 is discharged into the casing 110 through a discharge opening 146*a* of the discharge cover 146, and then is discharged to the outside of the compressor through the gas discharge pipe 114.

In the reciprocating compressor in accordance with the present invention constructed as above, the magnet 133 is coupled to the inner stator 132 that is coupled to the cylinder 141, thereby allowing components such as a conventional magnetic frame to be excluded. Accordingly, the number of components is reduced, so that a manufacturing cost can be desirably reduced.

In addition, as the magnet 133 is coupled to the inner stator 132, a distance between the magnet 13 and the inner stator 132 is not generated, thereby reducing an air gap (T) between the outer stator 131 and the inner stator 132. Therefore, the loss of magnetic force is prevented, so that performance of the compressor can be improved.

Also, because an outer diameter (D) formed by the magnet 133 becomes smaller due to the reduction of the air gap between the outer stator 131 and the inner stator 132, usage of the magnets 133 is reduced, and thus a manufacturing cost can be reduced.

In addition, making the inner stator 132 of soft magnetic composition can facilitate processing, thereby improving productivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A reciprocating compressor, comprising:

a frame disposed in a casing;

a piston fixedly installed at the frame, and having a suction passage;

a cylinder having a compression space configured to compress a refrigerant by inserting the piston, and reciprocating with respect to the piston;

an inner stator inserted into an outer circumferential surface of the cylinder;

a magnet mounted on an outer circumferential surface of the inner stator;

an outer stator having a certain air gap from the inner stator, and having a coil that forms a magnetic flux together with the magnet so that the cylinder reciprocates together with the inner stator and the magnet; and a resonant spring unit connected to the cylinder, for providing a resonant motion to a reciprocating motion of the cylinder, wherein the resonant spring unit comprises:

a spring sheet panel fixed to the cylinder; and a plurality of springs provided at both sides of the spring sheet panel.

2. The compressor of claim 1, wherein a suction valve for opening or closing the suction passage is installed at one side of the piston.

3. The compressor of claim 2, wherein a suction cover communicating with a suction pipe penetratingly installed at the casing for sucking a gas, and covering the suction passage is installed at a side opposite to a side where the suction valve of the piston is installed.

4. The compressor of claim 1, wherein the inner stator is made of a soft magnetic composition by powder metallurgy.

5. The compressor of claim 1, wherein the magnet is installed in plurality in a circumferential direction of an outer circumference of the inner stator.

6. The compressor of claim 1, wherein the magnet is formed as a cylindrical shape and is installed at an outer circumference of the inner stator.

7. The compressor of claim 1, further comprising:

a discharge valve installed at one side of the cylinder, for opening or closing a discharge passage of a compressed gas;

a valve spring for elastically supporting the discharge valve; and a discharge cover for receiving the discharge valve and the valve spring.

8. The compressor of claim 7, wherein a discharge opening through which a discharge gas is discharged into the casing is formed at the discharge cover.

9. The compressor of claim 1, wherein a width in an axial direction of the inner stator is wider than a width in an axial direction of the outer stator.

10. The compressor of claim 1, wherein a width in an axial direction of the magnet is wider than the half of a width in an axial direction of the outer stator.

11. The compressor of claim 1, wherein the cylinder is formed of a nonmagnetic body.

12. A reciprocating compressor, comprising:

a frame disposed in a casing;

a piston fixedly installed at the frame, and having a suction passage which is opened or closed by a suction valve which is installed at one side of the suction passage;

a cylinder having a compression space configured to compress a refrigerant by inserting the piston and is opened or closed by a discharge valve, and reciprocating with respect to the piston;

an inner stator inserted into an outer circumferential surface of the cylinder;

a magnet mounted on an outer circumferential surface of the inner stator;

an outer stator having a certain air gap from the inner stator, and having a coil that forms a magnetic flux together with the magnet so that the cylinder reciprocates together with the inner stator and the magnet;

a resonant spring unit connected to the cylinder, for providing a resonant motion to a reciprocating motion of the cylinder, wherein the resonant spring unit comprises:

a spring sheet panel fixed to the cylinder; and a plurality of springs provided at both sides of the spring sheet panel;

a suction cover covering one side of the suction passage, and directly communicating with a suction pipe penetratingly installed at the casing for directly sucking a gas; and a discharge cover covering the compression space of the cylinder, and having a discharge opening through which a discharge gas is discharged into the casing.

13. The compressor of claim 12, wherein the inner stator is made of a soft magnetic composition by powder metallurgy.

14. The compressor of claim 12, wherein the magnets is installed in plurality in a circumferential direction of an outer circumference of the inner stator.

15. The compressor of claim 12, wherein the magnet is formed as a cylindrical shape and is installed at an outer circumference of the inner stator.

16. The compressor of claim 12, wherein a width in an axial direction of the inner stator is wider than a width in an axial direction of the outer stator.

17. The compressor of claim 12, wherein a width in an axial direction of the magnet is wider than one half of a width in an axial direction of the outer stator.

18. The compressor of claim 12, wherein the cylinder is formed of a nonmagnetic body.

* * * * *